US006969794B2

(12) United States Patent
Suzuki

(10) Patent No.: US 6,969,794 B2
(45) Date of Patent: Nov. 29, 2005

(54) MUSIC PLAYBACK APPARATUS AND MUSIC PLAYBACK SYSTEM

(75) Inventor: Keizo Suzuki, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 359 days.

(21) Appl. No.: 10/261,091

(22) Filed: Sep. 30, 2002

(65) Prior Publication Data

US 2003/0089217 A1 May 15, 2003

(30) Foreign Application Priority Data

Oct. 23, 2001 (JP) ..... 2001-324841

(51) Int. Cl.[7] ..... G10H 1/00
(52) U.S. Cl. ..... 84/600; 369/2
(58) Field of Search ..... 84/600–609; 369/1–7; 707/1, 102; 709/203, 219, 231

(56) References Cited

U.S. PATENT DOCUMENTS 5,629,867 A * 5/1997 Goldman ..... 381/77
5,809,246 A * 9/1998 Goldman ..... 709/217
6,067,562 A * 5/2000 Goldman ..... 709/206
6,288,991 B1 * 9/2001 Kajiyama et al. ..... 369/47.23
6,377,530 B1 4/2002 Burrows
6,407,325 B2 6/2002 Yi et al.
6,496,802 B1 * 12/2002 van Zoest et al. ..... 705/14
6,609,105 B2 * 8/2003 Van Zoest et al. ..... 705/14
2001/0026287 A1 * 10/2001 Watanabe ..... 345/764
2002/0031065 A1 * 3/2002 Kajiyama et al. ..... 369/47.23
2004/0001395 A1 * 1/2004 Keller et al. ..... 369/30.09

* cited by examiner

*Primary Examiner*—Marlon T. Fletcher
*Assistant Examiner*—David Warren
(74) *Attorney, Agent, or Firm*—Brinks Hofer Gilson & Lione

(57) ABSTRACT

The data of the same musical pieces are stored in the same order in each of a plurality of music playback apparatuses. When one music playback apparatus is instructed to finish musical-piece playback, it generates musical-piece playback information indicating the playback order of the musical piece being played at that time, and sends the musical-piece playback information to a mobile telephone. The mobile telephone receives the musical-piece playback information and stores it in its internal memory. When the mobile telephone is moved to a position around another of the music playback apparatuses, the mobile telephone sends the musical-piece playback information to the other music playback apparatus. When the other music playback apparatus is instructed to start musical-piece playback, it selects the musical piece to be played back next, according to the musical-piece playback information sent from the mobile telephone, reads the data of the selected musical piece, and starts playing back the musical piece.

17 Claims, 15 Drawing Sheets

MUSIC PLAYBACK APPARATUS AND MUSIC PLAYBACK SYSTEM

BACKGROUND OF THE INVENTION

1. Field of the Invention

The present invention relates to music playback apparatuses and music playback systems for performing music playback by using musical-piece data stored in recording media such as hard disk apparatuses and various types of semiconductor memories.

2. Description of the Related Art

Music playback apparatuses for performing music playback by using musical-piece data stored in recording media, such as hard disk apparatuses and various types of semiconductor memories, have become more widespread in recent years. Such music playback apparatuses include apparatuses only for playing back music, and those using a personal computer or an on-vehicle computer (such as a navigation apparatus) which has a hard disk apparatus to execute a predetermined program.

The prices of recording media, such as hard disk apparatuses, have been decreasing and various types of apparatuses, such as personal computers, have included large-capacity (several tens of gigabytes to several hundreds of gigabytes, for example) hard disk apparatuses. When musical-piece data is stored in a 100-GB hard disk apparatus, for example, the apparatus can store the data of 200 musical pieces, assuming that the data is not as compressed as that recorded in a CD and the amount of data for one musical piece is 50 MB. The apparatus can store the data of 2,000 musical pieces assuming that the data is compressed according to a standard, such as MP3 (MPEG1 audio layer 3) and the amount of data for one musical piece is 5 MB. The user can use a personal computer installed at the house or an on-vehicle computer to reproduce musical-piece data stored in a hard disk apparatus to enjoy the music.

When the data of a great number of musical pieces is stored in each of a plurality of music playback apparatuses, if a musical piece which has been played back by one music playback apparatus (such as a music playback apparatus in one's house) is not played back repeatedly by another music playback apparatus (such as a music playback apparatus installed in one's vehicle), it is necessary to perform a musical-piece selection operation before playing back music with each music playback apparatus. The operation becomes complicated and inconvenient.

SUMMARY OF THE INVENTION

The present invention has been made in consideration of the foregoing situation. An object of the present invention is to provide a music playback apparatus and a music playback system which can play back musical pieces without repeatedly playing back musical pieces which have been played back and without a complicated operation.

To solve the foregoing problem, a music playback apparatus according to the present invention stores the data of a plurality of musical pieces to be played back in a storage section and plays back the plurality of musical pieces, whose data is stored in the storage section, by a musical-piece playback section. A musical-piece-playback-information generation section generates musical-piece playback information indicating the playback order of the musical piece being played back when the musical-piece playback section included in the local apparatus has started musical-piece playback and finishes it. A musical-piece-playback-information sharing section shares the musical-piece playback information between the local apparatus and another music playback apparatus or a plurality of other music playback apparatuses. A musical-piece selection section selects the musical piece to be played back next by the musical-piece playback section, according to the shared musical-piece playback information.

A music playback system according to the present invention has a plurality of music playback apparatuses each of which includes a storage section for storing the data of a plurality of musical pieces to be played back, and a musical-piece playback section for playing back the plurality of musical pieces, whose data is stored in the storage section. Each of the plurality of music playback apparatuses generates musical-piece playback information indicating the playback order of the musical piece being played back when the musical-piece playback section included in the local apparatus has started musical-piece playback and finishes it, by a musical-piece-playback-information generation section; shares the musical-piece playback information between the local apparatus and another music playback apparatus or a plurality of other music playback apparatuses by a musical-piece-playback-information sharing section; and selects the musical piece to be played back next by the musical-piece playback section, according to the shared musical-piece playback information by a musical-piece selection section.

Since the musical-piece playback information indicating the playback order of the musical piece being played back when playback is finished is shared between the local apparatus and another apparatus or the other apparatuses, and the musical piece to be played back next is selected according to the musical-piece playback information, musical-piece playback is performed without any complicated operation and without the repetitive playback of musical pieces which have been played back.

When the data of the same musical pieces are stored in the same order in the storage section included in each of the plurality of music playback apparatuses described above, it is preferred that the musical-piece playback information include identification information for the musical piece played back last, and the musical-piece selection section select the musical piece to be played back next, stored in the storage section, according to the identification information included in the musical-piece playback information. In this case, even when any of the plurality of music playback apparatuses is used to perform musical-piece playback, the musical pieces stored in the storage section can be played back in their playback order.

It is also preferred that the musical-piece playback information include history information for musical pieces which have been played back so far, and the musical-piece selection section select a musical piece other than the musical pieces identified by the history information as the musical piece to be played back next. In this case, even when the content and the storage order of the musical-piece data stored in the storage sections differ, musical-piece playback can be performed without playing back musical pieces which have been played back by other music playback apparatuses. In addition, even when the playback order of musical pieces is set at random, that is, a so-called random playback is performed, musical pieces can be played back in one music playback apparatus such that musical pieces which have already been played back in another music playback apparatus are not played back again.

It is preferred that the above-described musical-piece-playback-information sharing section is formed of a communication section for connecting a musical-piece-playback-information storage section provided for each of the plurality of music playback apparatuses to the plurality of music playback apparatuses. It is preferred that, when the musical-piece-playback-information generation section included in the local apparatus generates the musical-piece playback information, the communication section be used to send the musical-piece playback information to other apparatuses to store the musical-piece playback information in the musical-piece-playback-information storage sections included in the local apparatus and the other apparatuses in common, and the musical-piece selection section obtain the musical-piece playback information stored in the musical-piece-playback-information storage section. Since the plurality of music playback apparatuses are connected to each other through the communication section, the musical-piece playback information is easily and positively shared.

It is preferred that the above-described musical-piece-playback-information sharing section be formed of a portable terminal apparatus provided with a musical-piece-playback-information storage section and provided outside the plurality of music playback apparatuses, and a communication section for connecting the portable terminal apparatus to each of the plurality of music playback apparatuses. It is preferred that, when the musical-piece-playback-information generation section included in the local apparatus generates the musical-piece playback information, the communication section be used to send the musical-piece playback information to the portable terminal apparatus to store the musical-piece playback information in the musical-piece-playback-information storage section, and, when the musical-piece-playback-information generation section included in the local apparatus performs musical-piece playback, the musical-piece selection section obtain the musical-piece playback information stored in the musical-piece-playback-information storage section of the portable terminal apparatus, through the communication section. The musical-piece playback information is easily shared at low cost by using the portable terminal apparatus, such as a mobile telephone, which the user usually carries.

It is preferred that the musical-piece-playback-information sharing section be formed of a transportable storage device which stores the musical-piece playback information and an input-and-output section provided for each of the plurality of music playback apparatuses, for providing the musical-piece playback information as an input to and output from the storage device. It is preferred that, when the musical-piece-playback-information generation section included in the local apparatus generates the musical-piece playback information, the input-and-output section write the musical-piece playback information into the storage device, and, when the musical-piece-playback-information generation section included in the local apparatus performs musical-piece playback, the musical-piece selection section read the musical-piece playback information from the storage device through the input-and-output section and obtains it. In this case, the musical-piece playback information is shared by using the transportable storage device. Imposed cost, such as a communication charge, is low compared with a case in which the information is shared through the communication section.

Further, it is preferred that the above-described musical-piece playback information include the playback order of the musical piece being played back when the musical-piece playback section finishes playback, and interruption-position information indicating the position of playback interruption in the musical piece, and the musical-piece selection section select the musical piece to be played back next by the musical-piece playback section and identify a playback-start position according to the interruption-position information. In this case, when the playback of a musical piece has been interrupted at the middle—and afterwards, the playback of the musical piece is again started—the playback of the musical piece is not started at the top, but the musical piece can be listened to from the interruption position without any special operation. This advantage is especially effective when a musical piece, such as classical music which requires a long performance time, is played back.

Further, it is preferred that the above-described musical-piece playback information include playback-state information for the musical-piece playback section, and the musical-piece playback section set a playback state according to the playback-state information when the musical-piece playback section plays back a musical piece next according to the musical-piece playback information. The playback-state information may include, for example, an equalizer setting state. Since the playback state is included in the musical-piece playback information, musical-piece playback is possible in the same environment without independently setting the playback state for each of the plurality of music playback apparatuses. Even when a different music playback apparatus is used, a complicated operation of independently performing fine settings, such as an equalizer state, is omitted, and operability can be improved.

As described above, according to the present invention, since musical-piece playback information indicating the playback order of the musical piece being played back when playback is finished is shared between the local apparatus and another apparatus, and the musical piece to be played back next is selected according to the shared musical-piece playback information, musical-piece playback is performed without any complicated operation and without the repetitive playback of musical pieces which have already been played back.

DESCRIPTION OF THE PREFERRED EMBODIMENTS

Figure 1:
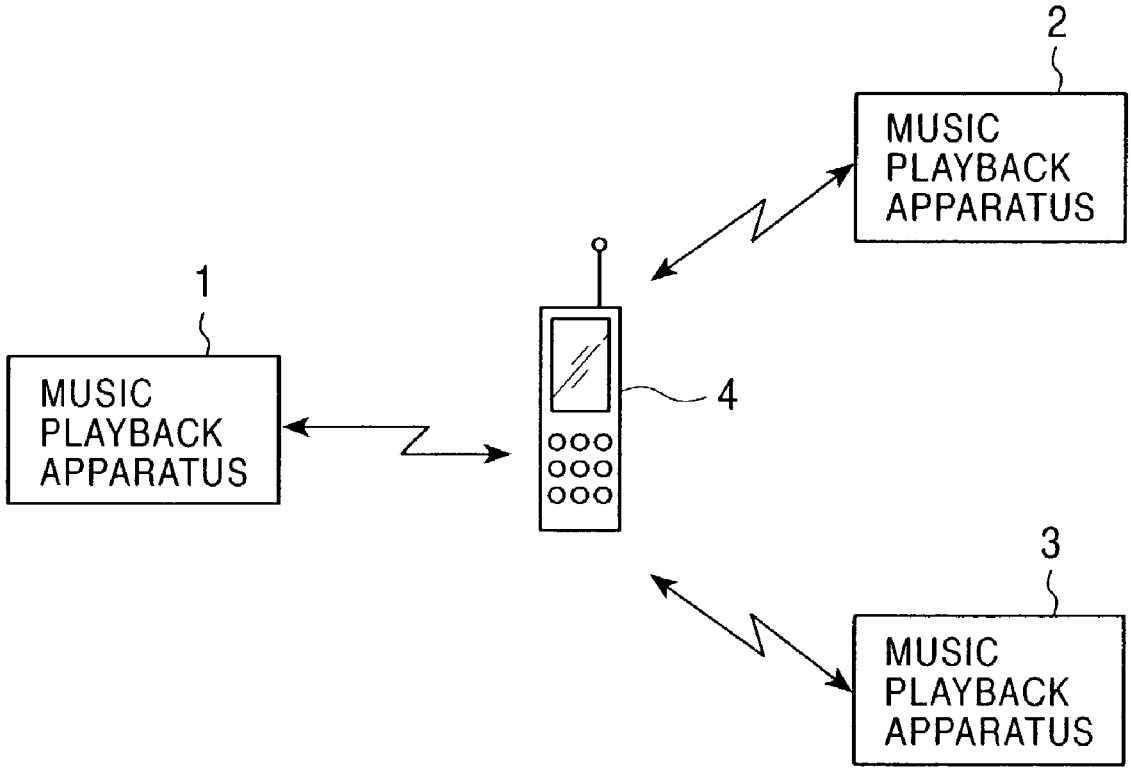
FIG. 1 illustrates the configuration of a music playback system according to a first embodiment.

Music playback systems according to embodiments of the present invention will be described below by referring to the drawings.

First Embodiment

FIG. 1 illustrates a music playback system according to a first embodiment. The music playback system shown in FIG. 1 includes music playback apparatuses 1, 2, and 3, and a mobile telephone 4. Each of the music playback apparatuses 1, 2, and 3 and the mobile telephone 4 can be connected to each other through predetermined radio communication.

The music playback apparatuses 1, 2, and 3 store the data of a plurality of musical pieces (hereinafter called musical-piece data) to be played back, in their internal hard disk apparatuses, and use the stored musical-piece data to play back the musical pieces.

The music playback apparatuses 1, 2, and 3 are installed at different places. For example, the music playback apparatus 1 is implemented when the user uses a personal computer installed at the house to execute a predetermined program. The music playback apparatus 2 is implemented when the user uses an on-vehicle computer (such as a navigation apparatus) installed in the user's vehicle to execute a predetermined program. The music playback apparatus 3 is implemented when the user uses a personal computer installed at the user's office to execute a predetermined program. The music playback apparatuses 1, 2, and 3 of the present embodiment have a function of transmitting and receiving data to and from the mobile telephone 4 by short-distance (for example, several-meter) radio communication. A detailed structure of the music playback apparatuses 1, 2, and 3 will be described later.

The mobile telephone 4 is used for calls between the user and other parties, and is implemented by a portable telephone or a personal handyphone system (PHS), which have become widespread. The mobile telephone 4 of the present embodiment has a function of transmitting and receiving data to and from the music playback apparatuses 1, 2, and 3 by short-distance (for example, several-meter) radio communication. A detailed structure of the mobile telephone 4 will be described later.

Figure 2:
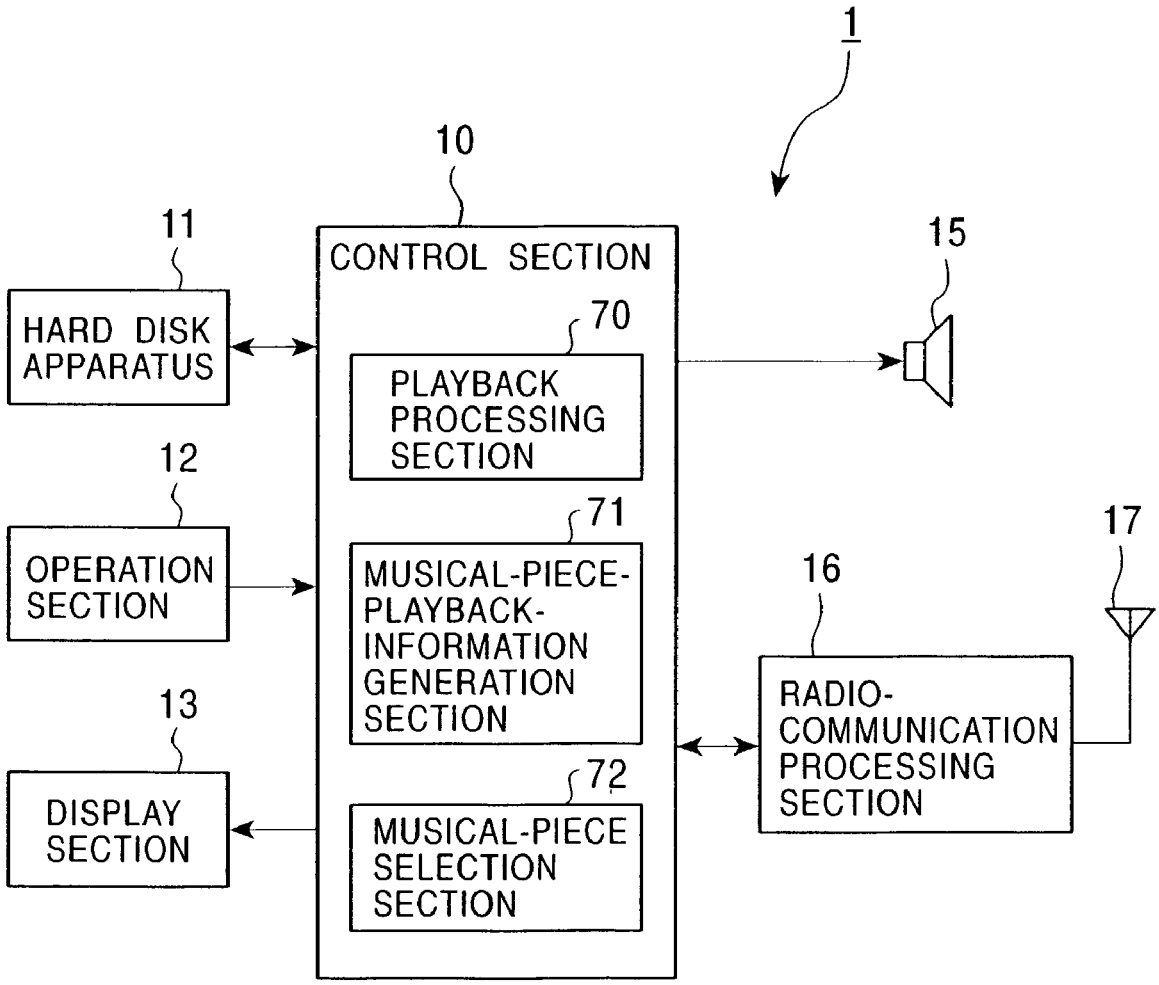
FIG. 2 illustrates a detailed structure of a music playback apparatus according to the first embodiment.

A detailed structure of the music playback apparatus 1 will be described next. FIG. 2 illustrates a detailed structure of the music playback apparatus 1 according to the first embodiment. As shown in FIG. 2, the music playback apparatus 1 includes a control section 10, a hard disk (HD) apparatus 11, an operation section 12, a display section 13, a speaker 15, a radio-communication processing section 16, and an antenna 17. The other music playback apparatuses 2 and 3 also have the same structure as the music playback apparatus 1, and therefore, a detailed description thereof is omitted.

The control section 10 controls the entire operation of the music playback apparatus 1, and includes a playback processing section 70, a musical-piece-playback-information generation section 71, and a musical-piece selection section 72. The control section 10 is implemented when a CPU, a ROM, a RAM, and other components are used to execute a predetermined program.

The playback processing section 70 reads musical-piece data stored in the hard disk apparatus 11, play backs musical pieces, and supplies the audio signals corresponding to the musical pieces to the speaker 15.

The musical-piece-playback-information generation section 71 generates musical-piece playback information indicating the playback order of the musical piece being played back when musical-piece playback performed by the playback processing section 70 is finished, and sends the information to the mobile telephone 4. The musical-piece playback information generated by the musical-piece-playback-information generation section 71 includes identification information which identifies the musical piece played back last by the playback processing section 70. In addition, the musical-piece playback information generated by the musical-piece-playback-information generation section 71 is shared by the music playback apparatuses 1, 2, and 3. Details of a method for sharing the musical-piece playback information will be described later.

The musical-piece selection section 72 selects a musical piece to be played back next by the playback processing section 70 according to the musical-piece playback information shared by the local apparatus (music playback apparatus 1) and a plurality of other apparatuses (music playback apparatuses 2 and 3).

The hard disk apparatus 11 includes a hard disk serving as a recording medium, and stores the musical-piece data corresponding to a plurality of (for example, several hundred to several thousand) musical pieces to be played back. In the present embodiment, the musical-piece data corresponding to the same musical pieces are stored in the same order in the hard disk apparatus 11 provided for the music playback apparatus 1 and in the hard disk apparatuses 11 provided for the other music playback apparatuses 2 and 3.

The operation section 12 has various types of operation keys, and supplies a signal corresponding to an operation content to the control section 10. In the music playback apparatuses 1 and 3, which are implemented by using personal computers, for example, the operation sections 12 include a keyboard provided with operation keys, such as alphabet keys and numeral keys, and a pointing device for moving a pointer on a screen to specify a desired point. In the music playback apparatus 2, which is implemented by using the on-vehicle computer, the operation section 12 includes a remote control unit and a touch-sensitive panel.

The display section 13 displays the image according to an image signal supplied from the control section 10. The speaker 15 produces the played-back sound of the musical piece according to an audio signal supplied from the control section 10.

The radio-communication processing section 16 is connected to the antenna 17, and performs communication processing for transmitting and receiving data to and from the mobile telephone 4 according to a predetermined radio communication standard. In the present embodiment, data is transmitted and received according to a radio communication standard called Bluetooth (registered trademark), which uses a 2.4-GHz-band electromagnetic wave to perform communication within a relatively short distance (about several meters).

Figure 3:
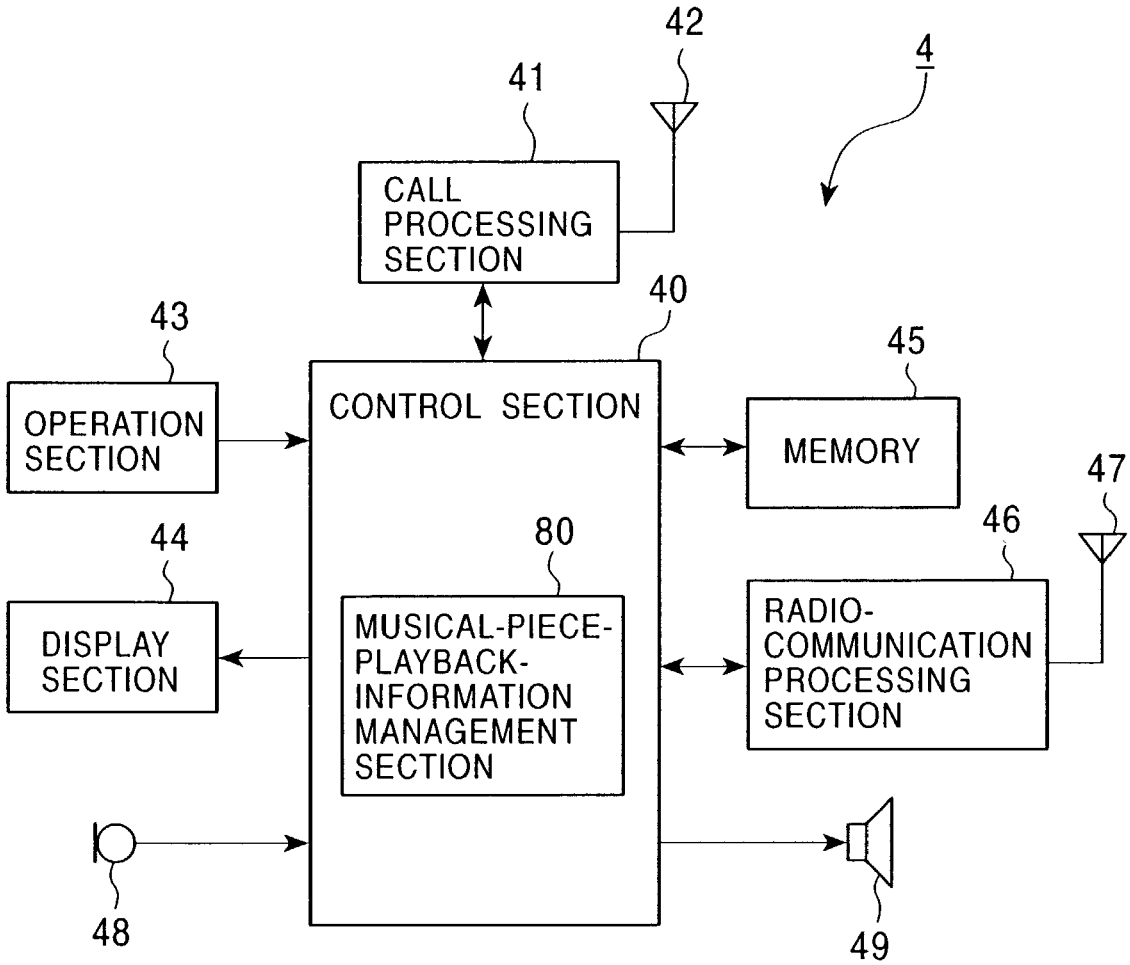
FIG. 3 illustrates a detailed structure of a mobile telephone.

A detailed structure of the mobile telephone 4 will be described next. FIG. 3 illustrates a detailed structure of the mobile telephone 4. The mobile telephone 4 includes a control section 40, a call processing section 41, antennas 42 and 47, an operation section 43, a display section 44, a memory 45, a radio-communication processing section 46, a microphone 48, and a speaker 49.

The control section 40 controls the entire operation of the mobile telephone 4, and includes a musical-piece-playback-information management section 80. The musical-piece-playback-information management section 80 stores musical-piece playback information sent from the music playback apparatus 1 or others in the memory 45, and reads the musical-piece playback information stored in the memory 45 and sends it to the music playback apparatus 1 or others located around the mobile telephone 4.

The call processing section 41 is connected to the antenna 42, and performs various types of processing for calls. Specifically, the call processing section 41 receives, by the antenna 42, an electromagnetic wave sent from an external base station and demodulates the corresponding signal to generate an audio signal to supply to the speaker 49, and modulates an audio signal supplied from the microphone 48 to produce an electromagnetic wave to be sent to an external base station from the antenna 42.

The operation section 43 includes various types of operation keys, and supplies a signal corresponding to an operation content to the control section 40. The display section 44 displays the image according to an image signal supplied from the control section 40.

The memory 45 stores musical-piece playback information received from the music playback apparatus 1 or others by using radio communication.

The radio-communication processing section 46 is connected to the antenna 47, and performs communication processing for transmitting and receiving data to and from the music playback apparatus 1 or others according to a predetermined radio communication standard. In the present embodiment, data is transmitted and received according to a radio communication standard called Bluetooth, as described above.

The microphone 48 collects the voice of the user, converts it to an analog audio signal, and supplies it to the control section 40. The speaker 49 produces the voice of the other party according to an audio signal supplied from the control section 40.

The hard disk apparatus 11 described above corresponds to a storage section, the speaker 15 and the playback processing section 70 correspond to a musical-piece playback section, the musical-piece-playback-information generation section 71 corresponds to a musical-piece-playback-information generation section, and the musical-piece selection section 72 corresponds to a musical-piece selection section. In addition, the mobile telephone 4 corresponds to a portable terminal apparatus, the memory 45 corresponds to a musical-piece-playback-information storage section, and the radio-communication processing sections 16 and 46 and the antennas 17 and 47 correspond to a communication section.

The music playback system according to the present embodiment has the above-described structure. The operation thereof will be described next. The following description assumes that the user has finished musical-piece playback at the music playback apparatus 1 at the user's house, then gets in a vehicle and starts musical-piece playback with the music playback apparatus 2 installed in the vehicle. The operation is the same as in a case in which the user finishes musical-piece playback at the music playback apparatus 1 and then starts musical-piece playback with the music playback apparatus 3.

Figure 4:
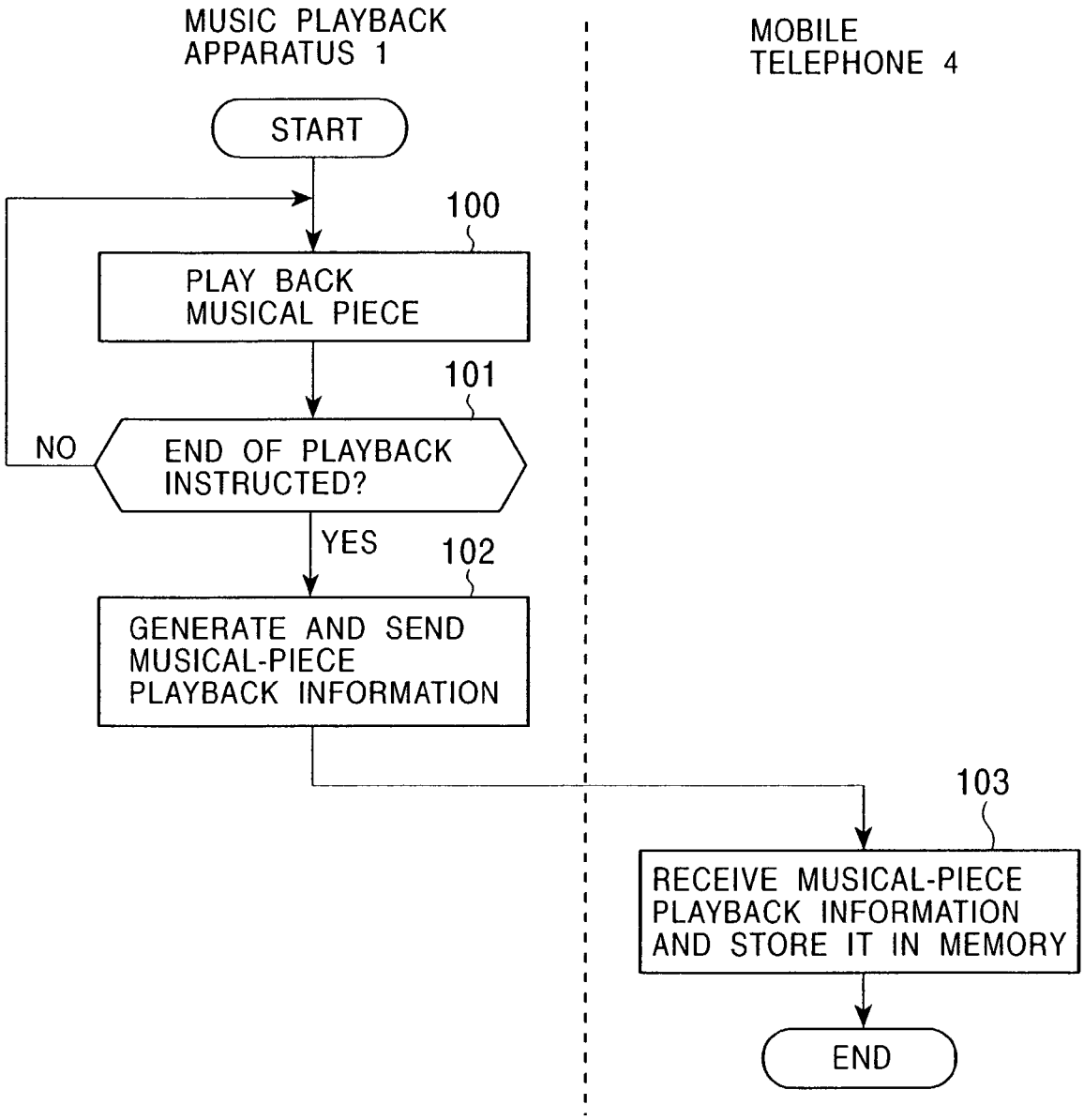
FIG. 4 is a flowchart of the operation of the music playback system, used when musical-piece playback is finished.

FIG. 4 is a flowchart showing the operation of the music playback system, used when musical-piece playback is finished. During musical-piece playback (in step 100), the playback processing section 70 of the music playback apparatus 1 determines (in step 101) whether an instruction for finishing the musical-piece playback has been entered. Until an instruction for finishing the musical-piece playback is entered, a negative result is always obtained, the procedure returns to step 100, and the musical-piece playback continues.

When an instruction for finishing the musical-piece playback is entered, an affirmative result is obtained in step 101, and the playback processing section 70 finishes the musical-piece playback. The musical-piece-playback-information generation section 71 generates musical-piece playback information, and sends it to the mobile telephone 4 (in step 102). More specifically, the musical-piece-playback-information generation section 71 provides the generated musical-piece playback information to the radio-communication processing section 16. The radio-communication processing section 16 sends the musical-piece playback information received from the musical-piece-playback-information generation section 71 to the mobile telephone 4.

When the music playback apparatus 1 sends the musical-piece playback information, the radio-communication processing section 46 of the mobile telephone 4 receives the musical-piece playback information, and supplies it to the musical-piece-playback-information management section 80. The musical-piece-playback-information management section 80 stores the musical-piece playback information received from the radio-communication processing section 46 in the memory 45 (in step 103).

With the above-described processing, the musical-piece playback information indicating the playback order of the musical piece being played back when the musical-piece playback was finished in the music playback apparatus 1 at the house of the user has been sent to the mobile telephone 4 and stored therein.

Figure 5:
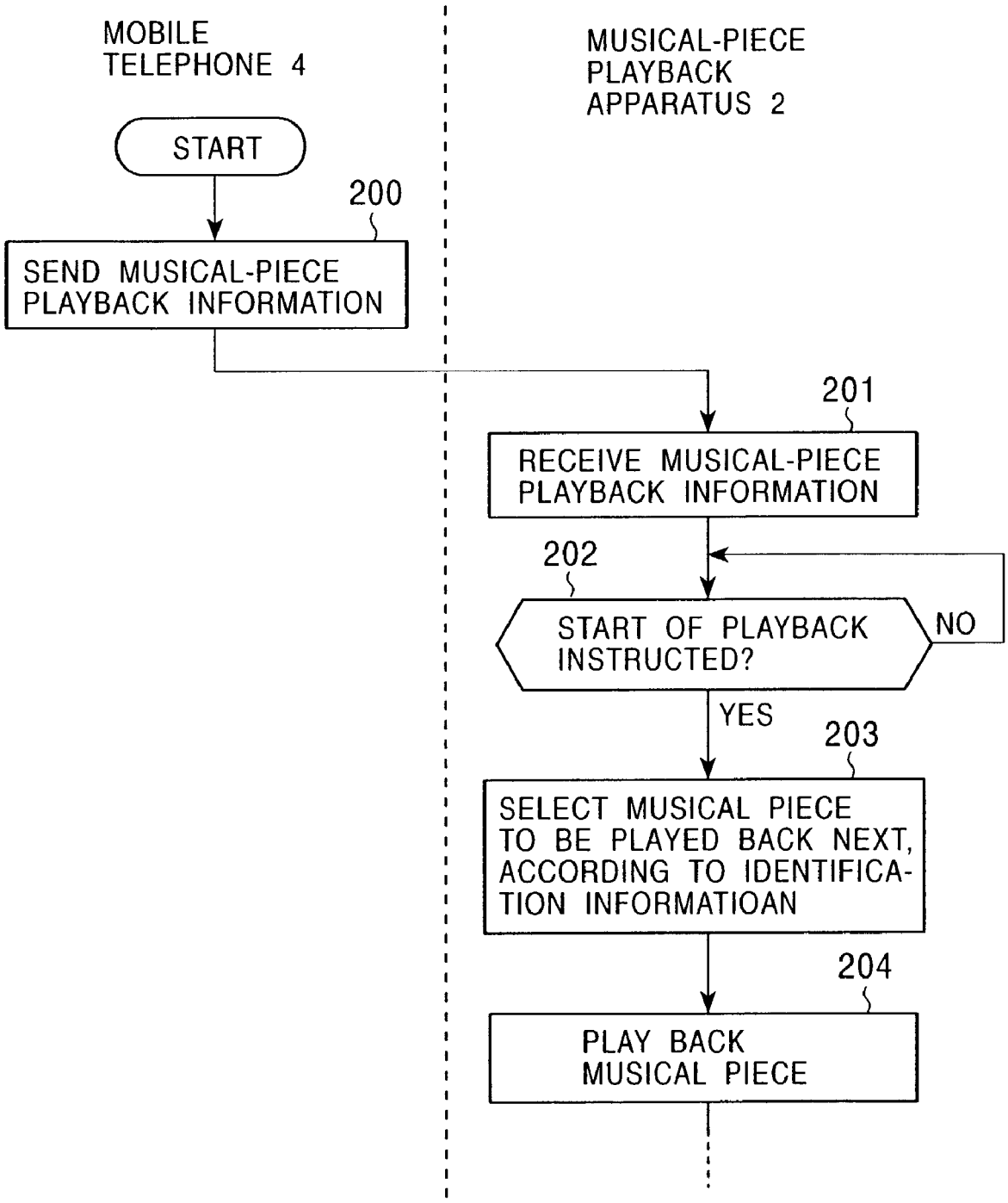
FIG. 5 is a flowchart of the operation of the music playback system, used when musical-piece playback is started according to musical-piece playback information.

FIG. 5 is a flowchart of the operation of the music playback system, used for starting musical-piece playback according to the musical-piece playback information.

When the mobile telephone 4 is moved to a point around the music playback apparatus 2, the musical-piece-playback-information management section 80 of the mobile telephone 4 reads the musical-piece playback information from the memory 45, and sends it to the music playback apparatus 2 (in step 200). More specifically, the musical-piece-playback-information management section 80 reads the musical-piece playback information from the memory 45 and supplies it to the radio-communication processing section 46. The radio-communication processing section 46 sends the musical-piece playback information received from the musical-piece-playback-information management section 80 to the music playback apparatus 2.

When the mobile telephone 4 sends the musical-piece playback information, the radio-communication processing section 16 of the music playback apparatus 2 receives the musical-piece playback information (in step 201), and supplies it to the control section 10.

The musical-piece selection section 72 of the control section 10 determines (in step 202) whether the start of musical-piece playback has been instructed. Until the start of musical-piece playback is instructed, a negative result is obtained, and the determination of step 202 is repeated.

When the start of musical-piece playback is instructed, a positive result is obtained in step 202, and the musical-piece selection section 72 selects the musical piece to be played back next (in step 203), according to the identification information included in the musical-piece playback information sent from the mobile telephone 4. For example, when the playback order of the musical piece identified by the identification information is the 750th, the musical-piece selection section 72 selects the musical piece whose playback order is the 751st.

Then, the playback processing section 70 reads the musical-piece data of the musical piece selected by the musical-piece selection section 72 from the hard disk apparatus 11, and starts playing back the musical piece (in step 204).

As described above, in the music playback system according to the first embodiment, the musical-piece playback information indicating the playback order of the musical piece which was being played back when the musical-piece playback was finished is shared through the mobile telephone 4 among the music playback apparatuses 1, 2, and 3. In addition, the musical piece to be played back next is selected according to the musical-piece playback information. Therefore, musical-piece playback is performed without a complicated operation and without the repetitive playback of already played-back musical pieces.

The data of the same musical pieces is stored in the same order in the hard disk apparatus 11 of each of the plurality of music playback apparatuses 1, 2, and 3; the musical-piece playback information which includes the identification information identifying the musical piece played back last is generated; and the musical piece to be played back next is selected according to the identification information included in the musical-piece playback information. Therefore, even when musical-piece playback is performed at any of the plurality of music playback apparatuses, the musical pieces stored in the hard disk apparatus 11 can be played back according to their playback order.

Since the musical-piece playback information is shared by using a portable terminal apparatus, such as a mobile telephone typically carried by the user, the musical-piece playback information is easily shared at a low cost.

Second Embodiment

In the first embodiment described above, the data of the same musical pieces is stored in the same order in the hard disk apparatus 11 of each of the plurality of music playback apparatuses 1, 2, and 3. The present invention also can be applied to a case in which the content and storage order of musical-piece data stored in each hard disk apparatus 11 are different. A music playback system according to the present invention will be described below in which the content and storage order of musical-piece data stored in hard disk apparatuses 11 provided for music playback apparatuses 1, 2, and 3 are different.

The general configuration of a music playback system according to a second embodiment and the structure of each of music playback apparatuses 1, 2, and 3 are the same as those described in the first embodiment, shown in FIG. 1 and FIG. 2. However, the operation of a musical-piece-playback-information generation section 71 and a musical-piece selection section 72 included in each of the music playback apparatuses 1, 2, and 3 are slightly different than those in the first embodiment.

Specifically, the musical-piece-playback-information generation section 71 generates history information identifying musical pieces which have been played back so far while a playback processing section 70 is performing a musical-piece playback operation, and stores the history information in a hard disk apparatus 11. The musical-piece-playback-information generation section 71 also generates musical-piece playback information which includes the history information when the playback processing section 70 finishes musical-piece playback, and sends the musical-piece playback information to a mobile telephone 4.

The musical-piece selection section 72 selects a musical piece other than the musical pieces identified in the history information, that is, the musical pieces which have already been played back, as the musical piece to be played back next by the playback processing section 70, according to the musical-piece playback information shared among the local apparatus (for example, music playback apparatus 1) and a plurality of other apparatuses (for example, music playback apparatuses 2 and 3).

The operation of the music playback system according to the second embodiment will be described next. The following description assumes that the user finishes musical-piece playback at the music playback apparatus 1 at the user's house, then gets in a vehicle and starts musical-piece playback with the music playback apparatus 2 installed in the vehicle. The operation is the same as in a case in which the user finishes musical-piece playback at the music playback apparatus 1 and then starts musical-piece playback with the music playback apparatus 3.

Figure 6:
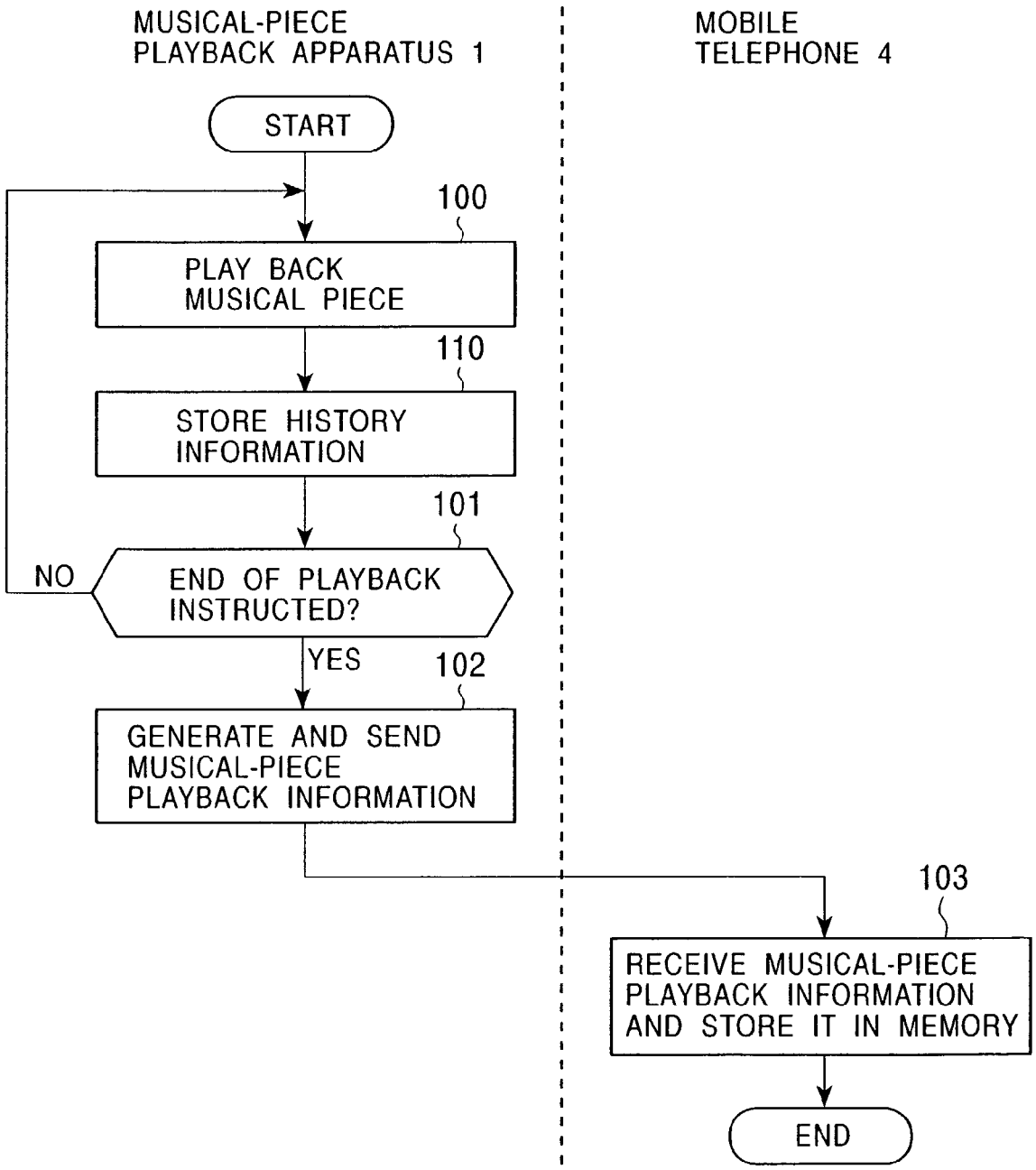
FIG. 6 is a flowchart of the operation of a second music playback system, used when musical-piece playback is finished.

FIG. 6 is a flowchart of the operation of the music playback system when musical-piece playback is finished. The operation shown in FIG. 6 is basically the same as that in the first embodiment, described above (by referring to FIG. 4), except that the process of step 110 is added between step 100 and step 101.

While the playback processing section 70 of the music playback apparatus 1 is performing musical-piece playback (in step 100), the musical-piece-playback-information generation section 71 generates history information indicating the musical pieces which have been played back so far, and stores it in the hard disk apparatus 11 (in step 110). More specifically, when predetermined sequence numbers have been assigned to musical pieces, the sequence numbers of musical pieces which have already been played back are extracted as history information. When the musical-piece data corresponding to each musical piece includes unique identification information (such as the musical-piece name or the artist name), the identification information is extracted as history information.

The playback processing section 70 also determines (in step 101) whether an instruction for finishing the musical-piece playback has been entered. Until an instruction for finishing the musical-piece playback is entered, a negative result is always obtained, the procedure returns to step 100, the musical-piece playback continues, and the content of the history information is updated as the musical-piece playback proceeds.

When an instruction for finishing the musical-piece playback is entered, an affirmative result is obtained in step 101, and the playback processing section 70 finishes the musical-piece playback. The musical-piece-playback-information generation section 71 reads the history information from the hard disk apparatus 11, generates musical-piece playback information which includes the history information, and sends it to the mobile telephone 4 (in step 102).

When the music playback apparatus 1 sends the musical-piece playback information, the radio-communication processing section 46 of the mobile telephone 4 receives the musical-piece playback information, and supplies it to the musical-piece-playback-information management section 80. The musical-piece-playback-information management section 80 stores the musical-piece playback information received from the radio-communication processing section 46 in the memory 45 (in step 103).

Figure 7:
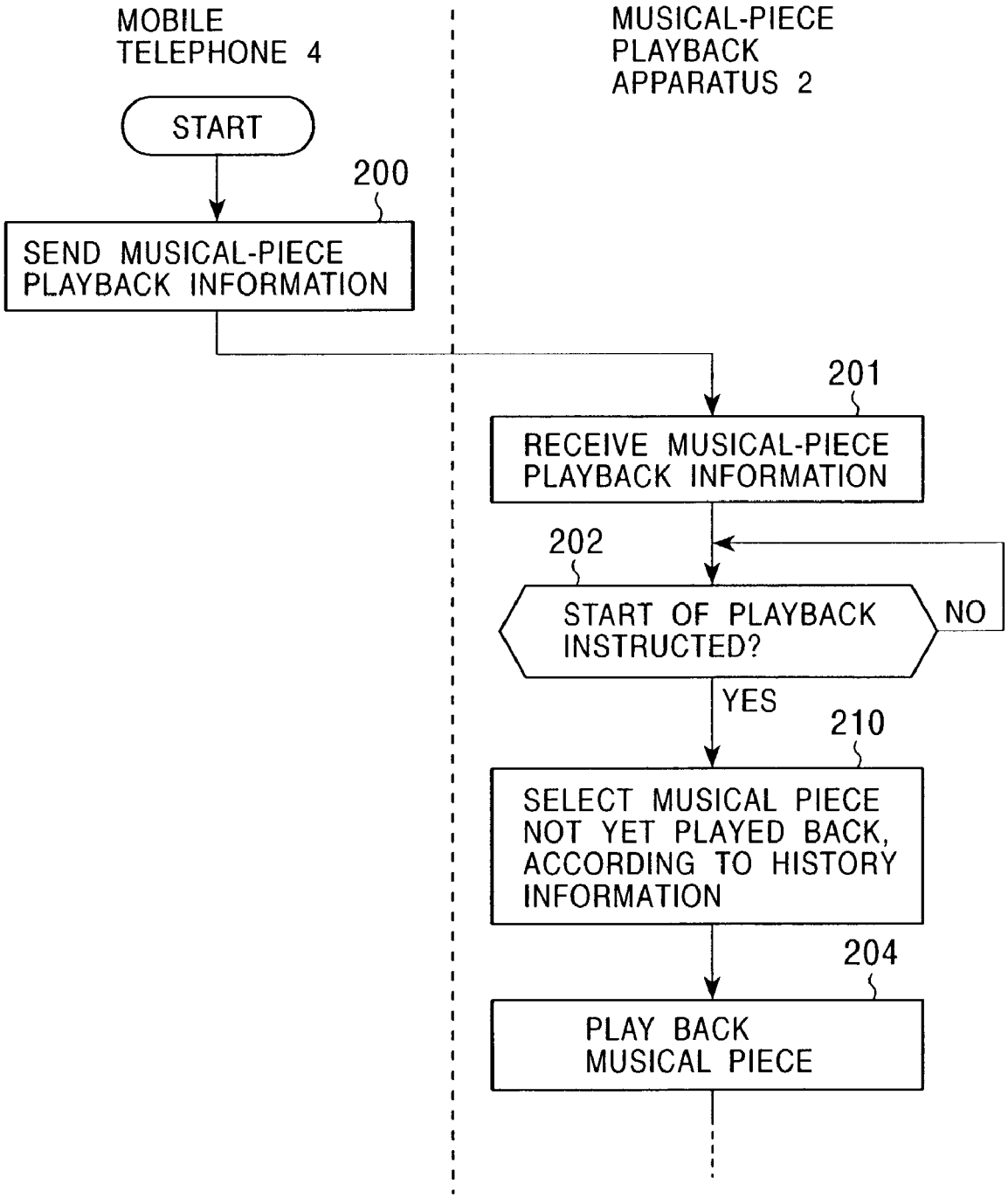
FIG. 7 is a flowchart of the operation of the second music playback system, used when musical-piece playback is started according to musical-piece playback information.

FIG. 7 is a flowchart of the operation of the music playback system when musical-piece playback is started according to the musical-piece playback information. The operation shown in FIG. 7 is basically the same as that in the first embodiment, described above (by referring to FIG. 5), except that the process of step 203 is replaced with that of step 210.

The musical-piece-playback-information management section 80 of the mobile telephone 4 reads the musical-piece playback information from the memory 45 and sends it to the music playback apparatus 2 (in step 200).

When the mobile telephone 4 sends the musical-piece playback information, the radio-communication processing section 16 of the music playback apparatus 2 receives the musical-piece playback information (in step 201) and supplies it to the control section 10.

The musical-piece selection section 72 of the control section 10 determines (in step 202) whether the start of musical-piece playback has been instructed. Until the start of musical-piece playback is instructed, a negative result is obtained, and the determination of step 202 is repeated.

When the start of musical-piece playback is instructed, an affirmative result is obtained in step 202, and the musical-piece selection section 72 selects a (not-yet-played-back) musical piece, other than the musical pieces which have already been played back by other music playback apparatuses, as the musical piece to be played back next by the playback processing section 70 (in step 210), according to the history information included in the musical-piece playback information sent from the mobile telephone 4.

Then, the playback processing section 70 reads the musical-piece data of the musical piece selected by the musical-piece selection section 72 from the hard disk apparatus 11 and starts playing back the musical piece (in step 204).

As described above, in the music playback system according to the second embodiment, since musical-piece playback information that includes the history information of musical pieces which have been played back so far is generated, and a musical piece other than the musical pieces identified by the history information is selected as the musical piece to be played back next, even when the content and storage order of musical-piece data stored in the various hard disk apparatuses differ, musical-piece playback can be performed for musical pieces which have not yet been played back by other music playback apparatuses or the local apparatus. Even if the playback order of musical pieces is set at random, that is, a so-called random playback is performed, musical-piece playback can be performed by one music playback apparatus for musical pieces which have not yet been played back by another music playback apparatus.

Third Embodiment

In the first and second embodiments, described above, the musical-piece playback information is shared through the mobile telephone 4 by the music playback apparatuses 1, 2, and 3. It is also possible that the music playback apparatuses 1, 2, and 3 are connected to each other through a predetermined network, and musical-piece playback information is shared.

Figure 8:
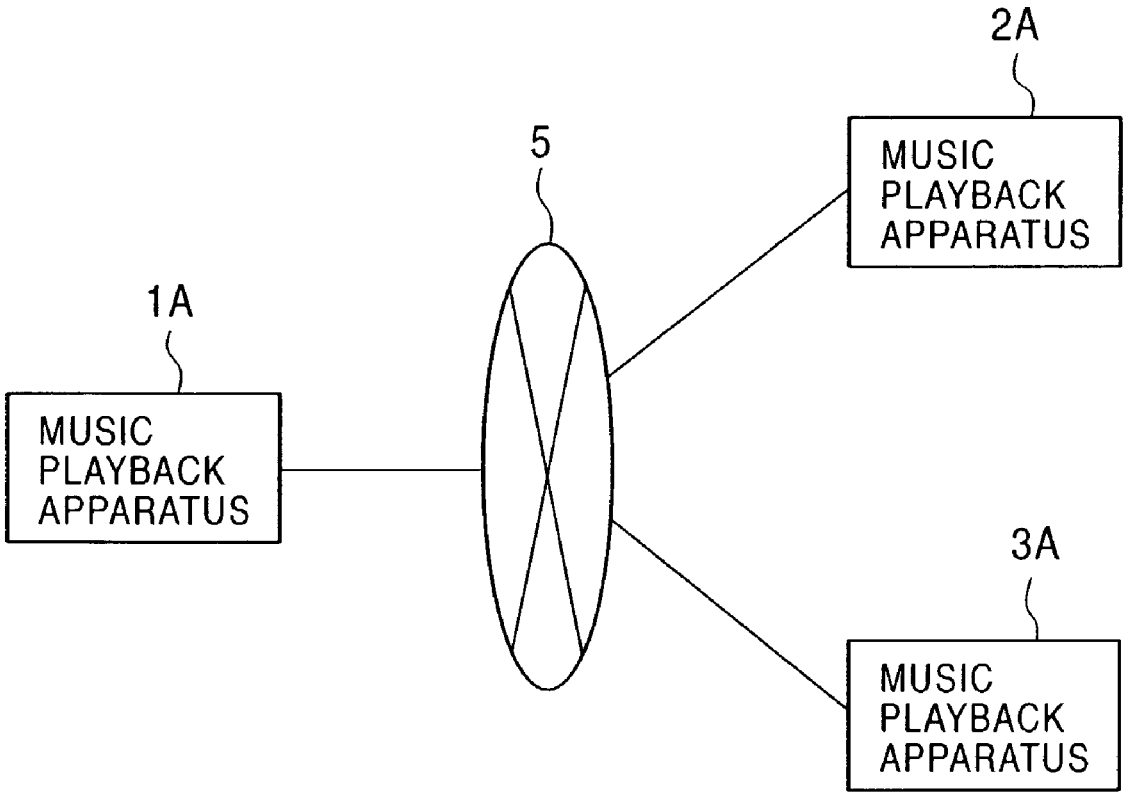
FIG. 8 illustrates the configuration of a music playback system according to a third embodiment.

FIG. 8 illustrates the structure of a music playback system according to a third embodiment. The music playback system shown in FIG. 8 includes music playback apparatuses 1A, 2A, and 3A and a network 5. The music playback apparatuses 1A, 2A, and 3A are connected to each other through the predetermined network 5, and musical-piece playback information is shared through the network 5.

Figure 9:
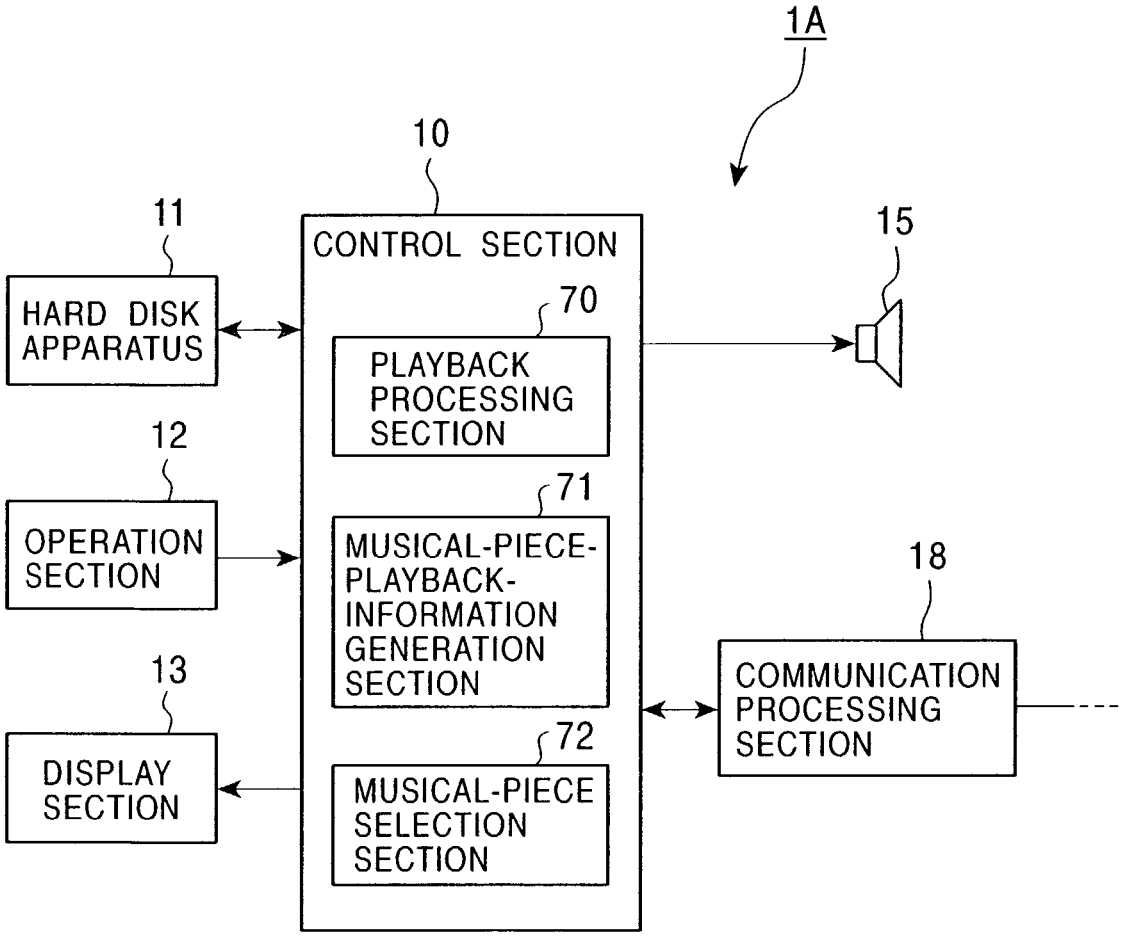
FIG. 9 illustrates a detailed structure of a music playback apparatus according to the third embodiment.

A detailed structure of the music playback apparatus 1A will be described next. As shown in FIG. 9, the music playback apparatus 1A includes a control section 10, a hard disk (HD) apparatus 11, an operation section 12, a display section 13, a speaker 15, and a communication processing section 18. The other music playback apparatuses 2A and 3A also have the same structure as the music-piece playback apparatus 1A.

The music playback apparatus 1A shown in FIG. 9 differs from the music playback apparatus 1 described in the first embodiment in that the radio-communication processing section 16 and the antenna 17 are omitted and the communication processing section 18 for data communication through the predetermined network 5 is added. The communication processing section 18 and the network 5 serves as a communication section for connecting the music playback apparatuses 1A, 2A, and 3A to each other.

In the present embodiment, musical-piece playback information generated by a musical-piece-playback-information generation section 71 included in one music playback apparatus is sent to the other music playback apparatuses, and also stored in a predetermined area of the hard disk apparatus 11. In the third embodiment, the hard disk apparatus 11 corresponds to a musical-piece-playback-information storage section provided for each of the music playback apparatuses 1A, 2A, and 3A.

The music playback system according to the third embodiment has such a structure. The operation thereof will be described next. Also in the third embodiment, the following description assumes that the user has finished musical-piece playback at the music playback apparatus 1 at the user's house, then gets in the vehicle, and begins musical-piece playback with the music playback apparatus 2 installed in the vehicle. In the same way as in the first embodiment, it is also assumed that the same musical-piece data is stored in the same order in the hard disk apparatuses 11 of the music playback apparatuses 1A, 2A, and 3A, and musical-piece playback information generated by the musical-piece-playback-information generation section 71 includes identification information identifying the musical piece played back last.

Figure 10:
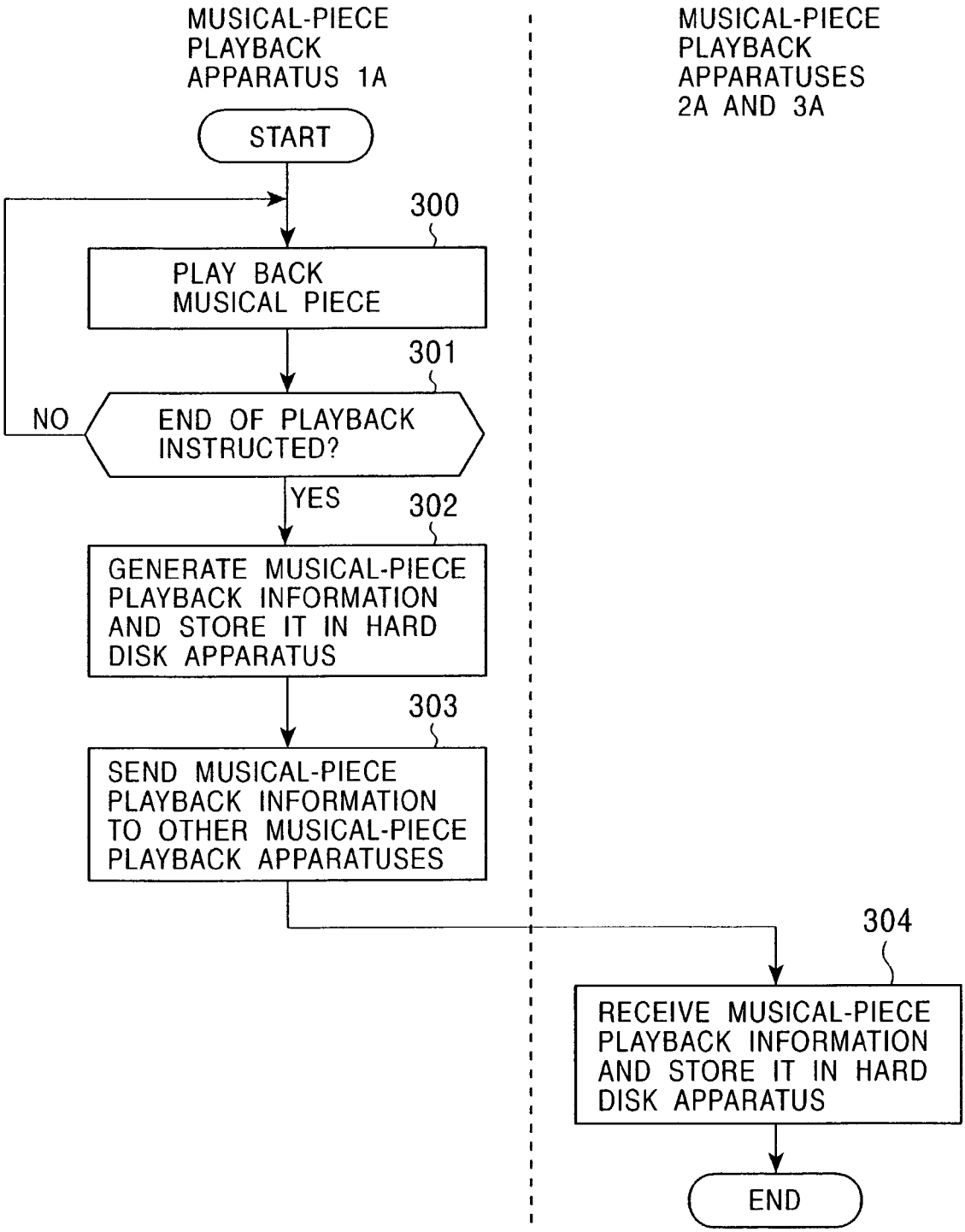
FIG. 10 is a flowchart of the operation of the music playback system, used when musical-piece playback is finished.

FIG. 10 is a flowchart showing the operation of the music playback system, used when musical-piece playback is finished. During musical-piece playback (in step 300), the playback processing section 70 of the music playback apparatus 1A determines (in step 301) whether an instruction for finishing the musical-piece playback has been entered. Until an instruction for finishing the musical-piece playback is entered, a negative result is always obtained, the procedure returns to step 300, and the musical-piece playback continues.

When an instruction for finishing the musical-piece playback is entered, an affirmative result is obtained in step 301, and the playback processing section 70 finishes the musical-piece playback. The musical-piece-playback-information generation section 71 generates musical-piece playback information, and stores it in the hard disk apparatus 11 (in step 302).

The musical-piece-playback-information generation section 71 also sends the generated musical-piece playback information to the other music playback apparatuses 2A and 3A (in step 303). More specifically, the musical-piece-playback-information generation section 71 supplies the generated musical-piece playback information to the communication processing section 18. The communication processing section 18 sends the musical-piece playback information received from the musical-piece-playback-information generation section 71 to the other music playback apparatuses 2A and 3A through the network 5.

When the music playback apparatus 1A sends the musical-piece playback information to the other music playback apparatuses 2A and 3A through the network 5, the control sections 10 of the music playback apparatuses 2A and 3A receive the musical-piece playback information, and store it in the hard disk apparatuses 11 (in step 304). With these operations, the musical-piece playback information is shared by the music playback apparatuses 1A, 2A, and 3A.

Figure 11:
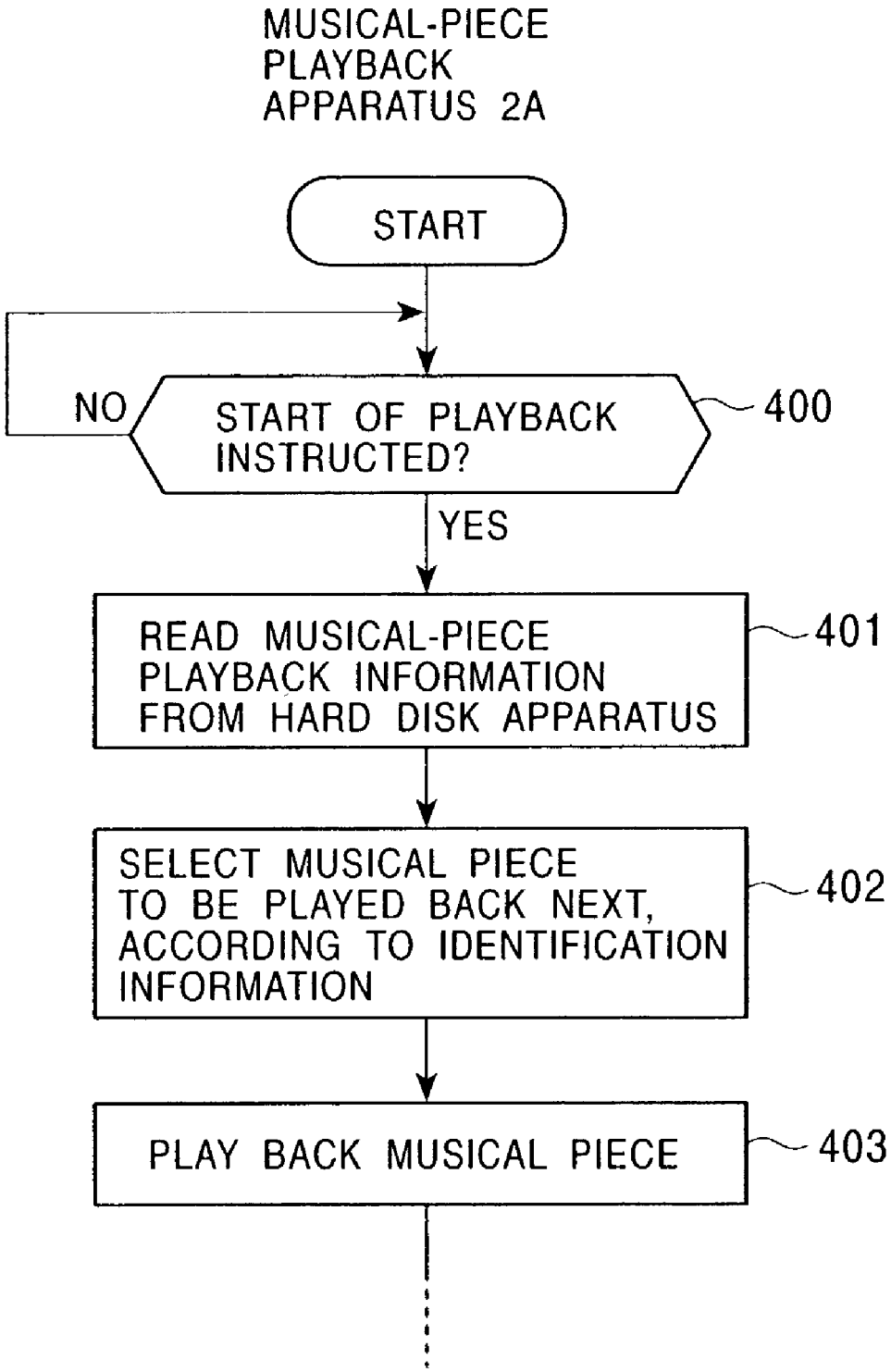
FIG. 11 is a flowchart of the operation of the music playback system, used when musical-piece playback is started according to musical-piece playback information.

FIG. 11 is a flowchart of the operation of the music playback system, used for starting musical-piece playback according to musical-piece playback information. FIG. 11 shows the operation content performed by the music playback apparatus 2A.

The musical-piece selection section 72 of the music playback apparatus 2A determines (in step 400) whether the start of musical-piece playback has been instructed. Until the start of musical-piece playback is instructed, a negative result is obtained, and the determination of step 400 is repeated.

When the start of musical-piece playback is instructed, an affirmative result is obtained in step 400, and the musical-piece selection section 72 reads the musical-piece playback information from the hard disk apparatus 11 (in step 401) and selects the musical piece to be played back next (in step 402), according to identification information included in the musical-piece playback information.

Then, the playback processing section 70 reads the musical-piece data of the musical piece selected by the musical-piece selection section 72 from the hard disk apparatus 11, and starts playing back the musical piece (in step 403).

As described above, since the music playback apparatuses 1A, 2A, and 3A are connected to each other through the network 5 in the music playback system according to the third embodiment, the musical-piece playback information is easily and positively shared.

In the third embodiment, described above, it has been assumed that the same musical-piece data is stored in the same order in the hard disk apparatuses 11 of the music playback apparatuses 1A, 2A, and 3A, and musical-piece playback information that includes identification information identifying the musical piece played back last is shared. The content and storage order of the musical-piece data stored in the hard disk apparatuses 11 may be different.

In this case, in the operation shown in FIG. 10, a process in which the musical-piece-playback-information generation section 71 generates history information identifying musical pieces which have been played back so far is added between step 300 and step 301, and the musical-piece playback information which includes the history information is sent to the other music playback apparatuses in step 303. In addition, in the operation shown in FIG. 11, the process of step 402 is omitted, and instead, a process for selecting a musical piece, other than those which have been already played back by other music playback apparatuses, as the musical piece to be played back next by the playback processing section 70 is performed.

Fourth Embodiment

In the first to third embodiments, the musical-piece playback information is shared through the mobile telephone 4 or through the network 5. Musical-piece playback information also may be shared among a plurality of music playback apparatuses by transferring the musical-piece playback information with the use of a transportable storage device.

Figure 12:
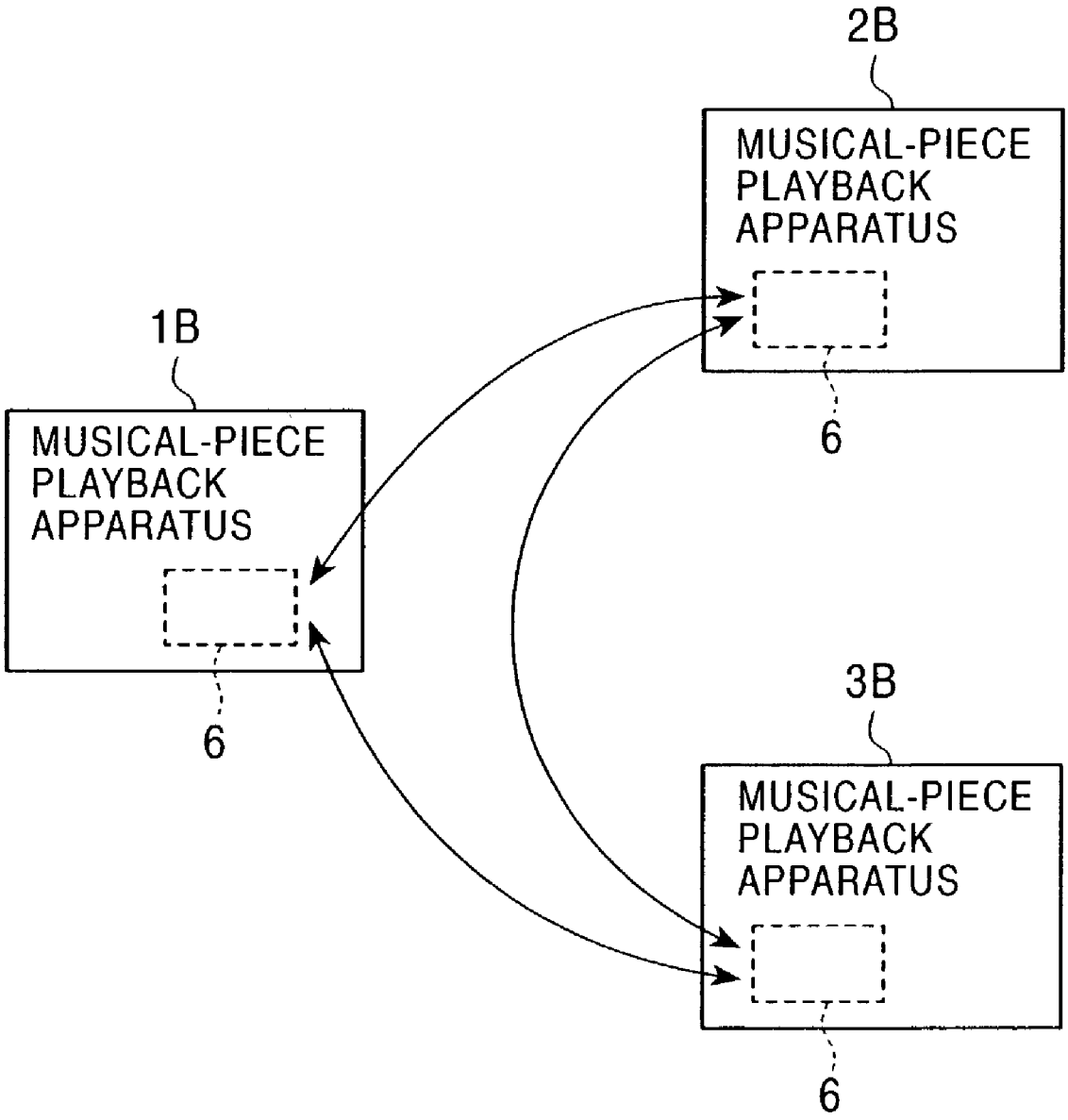
FIG. 12 illustrates the configuration of a music playback system according to a fourth embodiment.

FIG. 12 illustrates the structure of a music playback system according to a fourth embodiment. The music playback system shown in FIG. 12 includes music playback apparatuses 1B, 2B, and 3B and a memory card 6 serving as a transportable storage device. Each of the music playback apparatuses 1B, 2B, and 3B has an interface section for writing and reading data to and from the memory card 6. Musical-piece playback information is shared among the music playback apparatuses 1B, 2B, and 3B by transferring the musical-piece playback information through the memory card 6. The musical-piece playback information shared through the memory card 6 may include identification information identifying the musical piece played back last or may include history information identifying musical pieces which have been played back so far.

Figure 13:
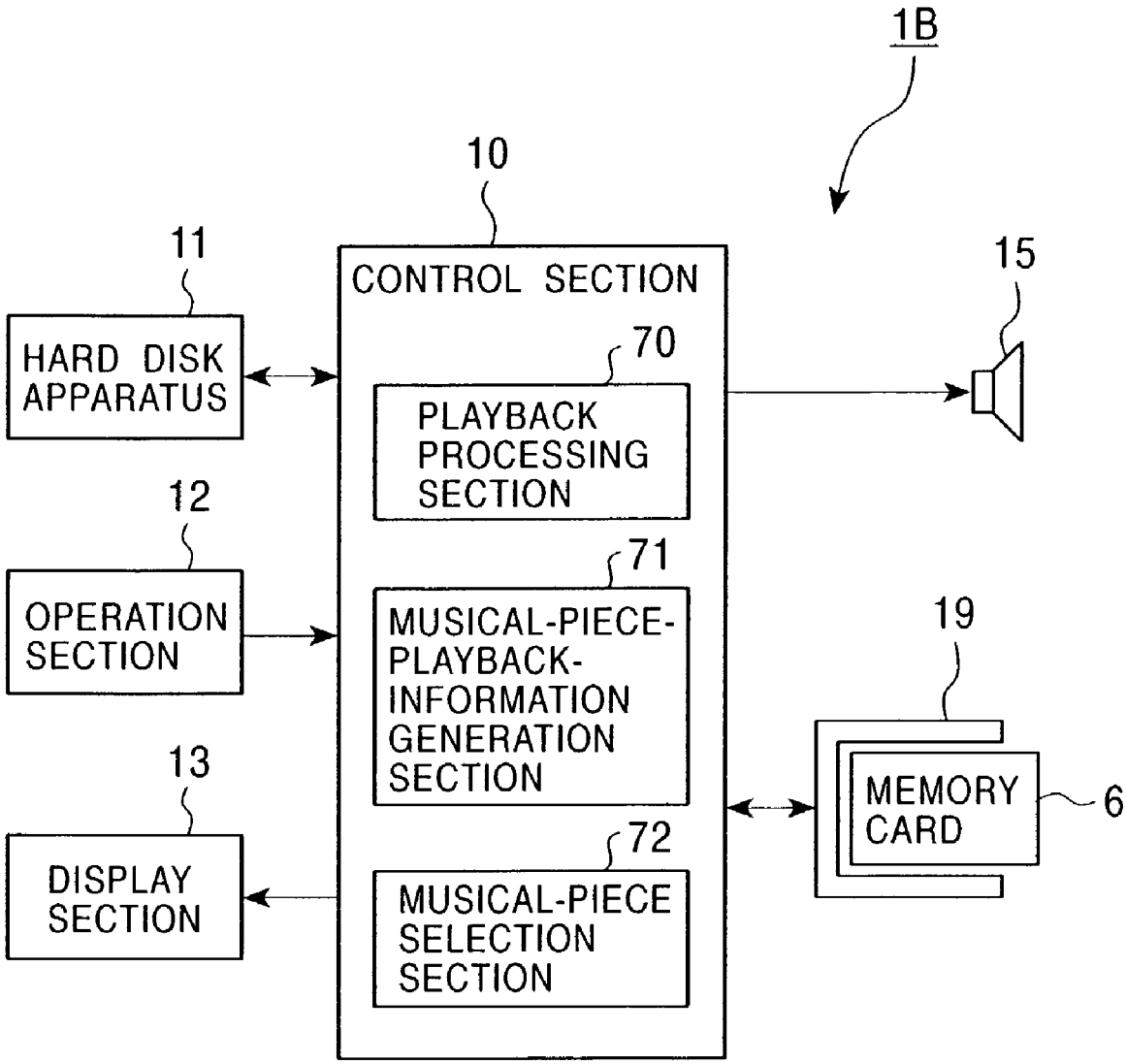
FIG. 13 illustrates a detailed structure of a music playback apparatus according to the fourth embodiment.

A detailed structure of the music playback apparatus 1B will be described next. FIG. 13 illustrates a detailed structure of the music playback apparatus 1B according to the fourth embodiment. As shown in FIG. 13, the music playback apparatus 1B includes a control section 10, a hard disk apparatus 11, an operation section 12, a display section 13, a speaker 15, and an input-and-output interface section 19. The other music playback apparatuses 2B and 3B have the same structure as the music playback apparatus 1B.

The music playback apparatus 1B shown in FIG. 13 differs from the music playback apparatus 1 described in the first embodiment in that the radio-communication processing section 16 and the antenna 17 are omitted, and the input-and-output interface section 19 for writing and reading data (musical-piece playback information) to and from the memory card 6 is added. The input-and-output interface section 19 corresponds to an input-and-output section.

A musical-piece-playback-information generation section 71 according to the present embodiment writes generated musical-piece playback information into the memory card 6 through the input-and-output section 19. A musical-piece selection section 72 according to the present embodiment reads the musical-piece playback information stored in the memory card 6 through the input-and-output section 19, and selects musical pieces to be played back.

The music playback system according to the fourth embodiment has such a structure, and the operation thereof will be described next. The operation of the music playback system according to the fourth embodiment is basically the same as that described in the first or second embodiment.

More specifically, when musical-piece playback is finished at the music playback apparatus 1B at the house of the user, the musical-piece-playback-information generation section 71 writes generated musical-piece playback information into the memory card 6 through the input-and-output interface section 19. Then, when the user removes the memory card 6 from the music playback apparatus 1B and loads it into the music playback apparatus 2B or the music playback apparatus 3B, the musical-piece selection section 72 of the music playback apparatus 2B or the music playback apparatus 3B reads the musical-piece playback information from the memory card 6 through the input-and-output interface section 19, and selects musical pieces to be played back.

As described above, musical-piece playback information is shared among the music playback apparatuses 1B, 2B, and 3B even with the use of the memory card 6 serving as a transportable storage device. In addition, imposed cost, such as a communication charge, is low in this embodiment, compared with a case in which musical-piece playback information is shared by data communication through a network.

Modifications

The present invention is not limited to the above-described embodiments. Within the scope of the present invention, various modifications are possible. For example, in any of the first to fourth embodiments, described above, the musical-piece-playback-information generation section 71 may generate musical-piece playback information which includes interruption-position information indicating the position where playback was interrupted in a musical piece when the playback processing section 70 stopped playing back the musical piece.

Figure 14:
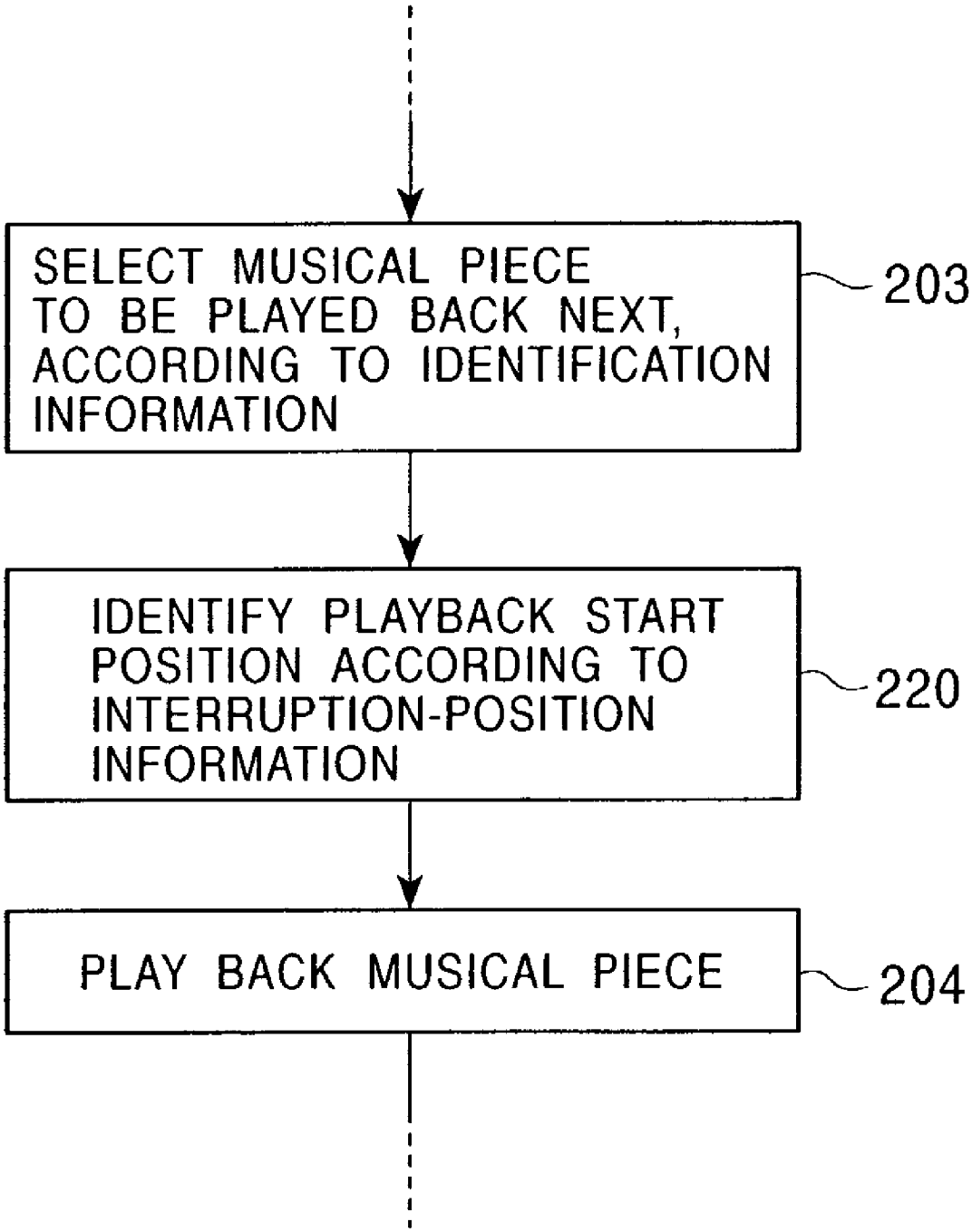
FIG. 14 is a flowchart of a partial operation of a music playback system, used when musical-piece playback is started according to musical-piece playback information which includes interruption-position information.

FIG. 14 is a flowchart of a partial operation of the music playback system, used for starting musical-piece playback according to musical-piece playback information which includes interruption-position information. The operation of the music playback system according to this modification differs from the operation procedure shown in FIG. 5 in that the process of step 220 is added between step 203 and step 204. FIG. 14 shows the modified portion.

When the start of musical-piece playback is instructed, the musical-piece selection section 72 selects the musical piece to be played back next according to identification information included in musical-piece playback information (in step 203).

Then, the musical-piece selection section 72 identifies the position where playback starts in the musical piece, according to interruption-position information included in the musical-piece playback information (in step 220).

Next, the playback processing section 70 reads the musical-piece data of the musical piece selected by the musical-piece selection section 72, from the hard disk apparatus 11, and starts playing back the musical piece at the playback-start position identified by the music-piece selection section 72 (in step 204).

As described above, since the interruption-position information is included in the musical-piece playback information, musical-piece playback can be restarted at the position where playback was interrupted, without any special operation. This advantage is especially effective when a musical piece, such as classical music, which requires a long performance time is played back.

The operation obtained by adding the process of step 220 to the operation described in the first embodiment (by referring to FIG. 5) has been described by referring to FIG. 14. The process of step 220 can also be added to the second to fourth embodiments. For example, in the second embodiment, the process of step 220 can be added between step 210 and step 204 in the operation shown in FIG. 7. In the third embodiment, the process of step 220 can be added between step 402 and step 403 in the operation shown in FIG. 11.

In any of the above-described embodiments, the musical-piece-playback-information generation section 71 may generate musical-piece playback information which includes playback-state information indicating the playback state (such as the setting state of an equalizer) of the playback processing section 70 when the playback processing section 70 finishes playing back a musical piece.

Figure 15:
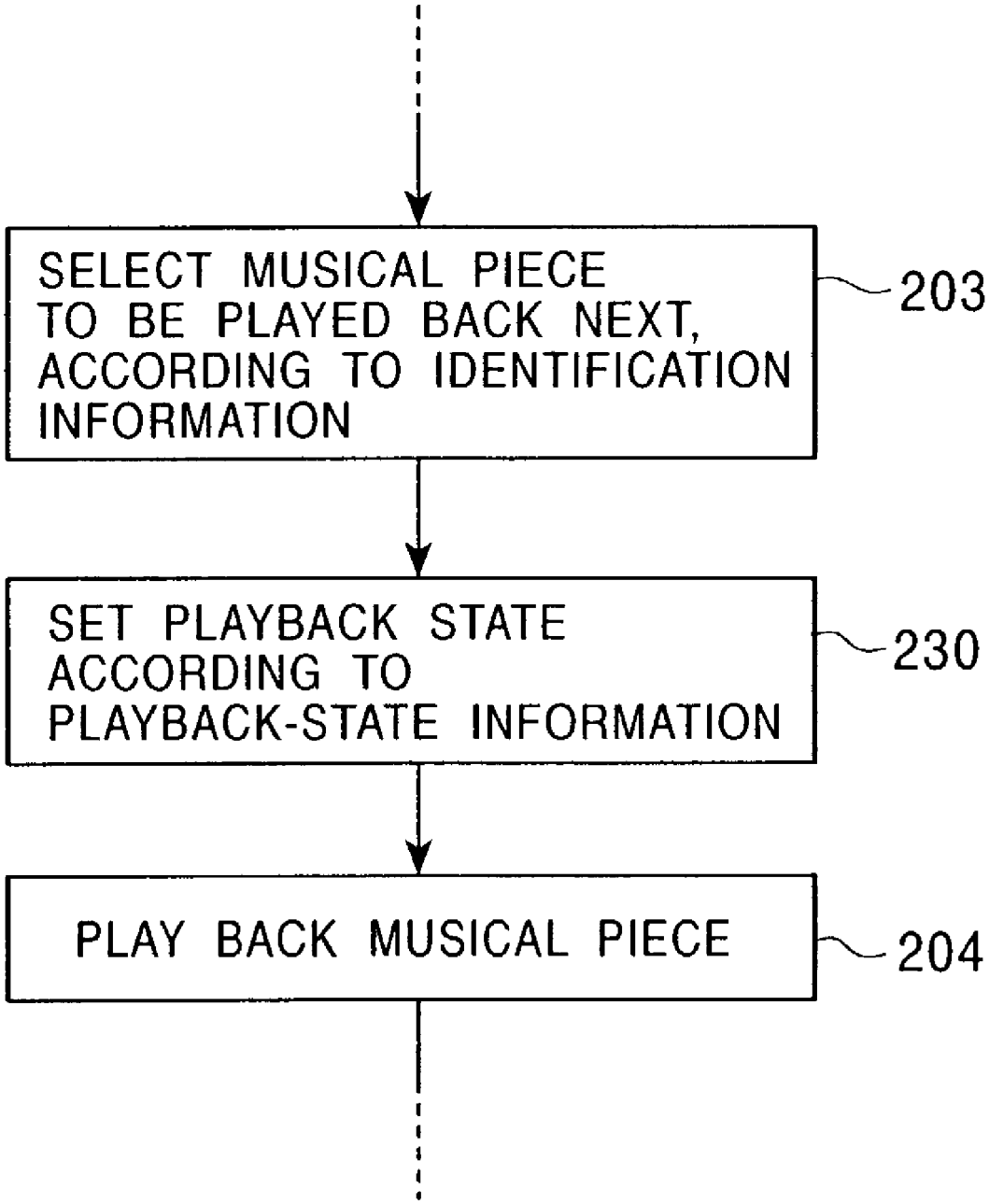
FIG. 15 is a flowchart of the operation of a music playback system, used when musical-piece playback is started according to musical-piece playback information which includes playback-state information.

FIG. 15 is a flowchart of a partial operation of the music playback system, used for starting musical-piece playback according to musical-piece playback information which includes playback-state information. The operation of the music playback system according to this modification differs from the operation shown in FIG. 5 in that the process of step 230 is added between step 203 and step 204. FIG. 15 shows the modified portion.

When the start of musical-piece playback is instructed, the musical-piece selection section 72 selects the musical piece to be played back next according to identification information included in musical-piece playback information (in step 203).

Then, the playback processing section 70 sets a playback state according to playback-state information included in the musical-piece playback information (in step 230).

Next, the playback processing section 70 reads the musical-piece data of the musical piece selected by the musical-piece selection section 72, from the hard disk apparatus 11, and starts playing back the musical piece (in step 204).

As described above, since the playback-state information is included in the musical-piece playback information, a complicated operation of independently setting a playback state (such as setting an equalizer) in the music playback apparatuses 1, 2, and 3 is omitted, and operability can be improved.

The operation obtained by adding the process of step 230 to the operation described in the first embodiment (by referring to FIG. 5) has been described by referring to FIG. 15. The process of step 230 can also be added to the second to fourth embodiments. For example, in the second embodiment, the process of step 230 can be added between step 210 and step 204 in the operation shown in FIG. 7. In the third embodiment, the process of step 230 can be added between step 402 and step 403 in the operation shown in FIG. 11.

In the first and second embodiments, described above, the musical-piece playback information is sent to the mobile telephone 4 when the user issues an instruction to finish musical-piece playback. Irrespective of whether the user issues such an instruction, however, the musical-piece playback information may be sent to the mobile telephone 4 at a predetermined timing (such as every time when the playback processing section 70 finishes playing back one musical piece). In the same way, in the third embodiment, irrespective of whether the user issues an instruction (to finish musical-piece playback), musical-piece playback information may be sent to the other music playback apparatuses at a predetermined timing. In the same way, in the fourth embodiment, irrespective of whether the user issues an instruction (to finish musical-piece playback), musical-piece playback information may be written into the memory card 6 at a predetermined timing.

In the first and second embodiments, described above, the mobile telephone 4 is used as an example of a portable terminal apparatus. However, the musical-piece playback information may be shared among the music playback apparatuses 1, 2, and 3 by using a portable terminal apparatus other than the mobile telephone 4. More specifically, information terminal apparatuses, such as personal digital assistants (PDAs) having a radio communication function, may be used as portable terminal apparatuses. A non-contact-type IC card also may be used as a portable terminal apparatus. In this case, each of the music playback apparatuses 1, 2, and 3 must be provided with an interface section for reading and writing data to and from the IC card.

In the first and second embodiments, described above, a radio communication standard called Bluetooth is used to transmit and receive musical-piece playback information between the mobile telephone 4 and each of the music playback apparatuses. Other communication standards, such as the Infrared Data Association (IrDA) standard for communications with an infrared rays serving as a transfer medium, also may be used.

In the third embodiment, described above, the musical-piece playback information is shared among the music playback apparatuses 1A, 2A, and 3A through the network 5. The content of the musical-piece data stored in the hard disk apparatus 11 provided for each of the music playback apparatuses 1A, 2A, and 3A may also be shared through the network 5. In this case, when the content of musical-piece data stored in the hard disk apparatus 11 provided for one music playback apparatus (for example, music playback apparatus 1) is changed, it is necessary that the music playback apparatus 1 sends the changed content of the musical-piece data to the other music playback apparatuses 2 and 3 through the network 5, and the music playback apparatuses 2 and 3 use the transmitted musical-piece data to update the corresponding musical-piece data stored in their hard disk apparatuses 11.

In the first to fourth embodiments, described above, each of the music playback apparatuses is implemented when a personal computer or an on-vehicle computer having a hard disk apparatus executes a predetermined program. The implementation form of the music playback apparatuses is not limited to this case, however. The music playback apparatuses may be implemented by apparatuses (so-called audio apparatuses) used only for music playback.

In the first to fourth embodiments, described above, each of the music playback apparatuses stores the musical-piece data in the hard disk apparatus. The musical-piece data may be stored in other recording media. For example, the musical-piece data may be stored in any disk-type recording media into which data can be written, such as CD-recordables (CD-Rs), CD-rewritables (CD-RWs), and DVD-RAMs. The musical-piece data may also be stored in a large-capacity semiconductor memory.

What is claimed is:

1. A music playback apparatus comprising:

a storage section in a local music playback apparatus for storing the data of a plurality of musical pieces to be played back;

a first musical-piece playback section for playing back the musical pieces, whose data is stored in the storage section;

a musical-piece-playback-information generation section for generating musical-piece playback information indicating a played musical piece when the first musical-piece playback section included in the local apparatus has started musical-piece playback and finishes it;

a musical-piece-playback-information sharing section for sharing the musical-piece playback information generated by the musical-piece-playback-information generation section between the local apparatus and at least one other music playback apparatus having a second musical-piece playback section; and a musical-piece selection section for selecting a musical piece to be played back next by the first musical-piece playback section, using the shared musical-piece playback information, wherein the shared musical-piece playback information includes information indicating a musical piece played by the second musical-piece playback section of the at least one other music playback apparatus.

2. A music playback apparatus according to claim 1, wherein the data of the same musical pieces are stored in the same order in the storage section included in each of the local apparatus and the at least one other music playback apparatus;

the musical-piece playback information includes identification information for the musical piece played back last; and the musical-piece selection section selects the musical piece to be played back next, stored in the storage section, according to the identification information.

3. A music playback apparatus according to claim 1, wherein the musical-piece playback information includes history information for musical pieces which have been played back so far; and the musical-piece selection section selects a musical piece other than the musical pieces identified by the history information as the musical piece to be played back next.

4. A music playback apparatus according to claim 1, wherein the musical-piece playback information includes the playback order of the musical piece being played back when the musical-piece playback section finishes playback, and interruption-position information indicating the position of playback interruption in the musical piece; and the musical-piece selection section selects the musical piece to be played back next by the musical-piece playback section and identifies a playback-start position according to the interruption-position information.

5. A music playback apparatus according to claim 1, wherein the musical-piece playback information includes playback-state information for the musical-piece playback section; and the musical-piece playback section sets a playback state according to the playback-state information when the musical-piece playback section plays back a musical piece next according to the musical-piece playback information.

6. A music playback system comprising a plurality of music playback apparatuses, each of the plurality of music playback apparatuses comprising:

a storage section in a local music playback apparatus for storing the data of a plurality of musical pieces to be played back;

a first musical-piece playback section for playing back the musical pieces, whose data is stored in the storage section;

a musical-piece-playback-information generation section for generating musical-piece playback information indicating a played musical piece when the first musical-piece playback section included in the local apparatus has started musical-piece playback and finishes it;

a musical-piece-playback-information sharing section for sharing the musical-piece playback information generated by the musical-piece-playback-information generation section between the local apparatus and at least one other music playback apparatus having a second musical-piece playback section; and a musical-piece selection section for selecting a musical piece to be played back next by the first musical-piece playback section, using the shared musical-piece playback information, wherein the shared musical-piece playback information includes information indicating a musical piece played by the second musical-piece playback section of the at least one other music playback apparatus.

7. A music playback system according to claim 6, wherein the data of the same musical pieces are stored in the same order in the storage section included in each of the plurality of music playback apparatuses;

the musical-piece playback information includes identification information for the musical piece played back last; and the musical-piece selection section selects the musical piece to be played back next, stored in the storage section, according to the identification information.

8. A music playback system according to claim 6, wherein the musical-piece playback information includes history information for musical pieces which have been played back so far; and the musical-piece selection section selects a musical piece other than the musical pieces identified by the history information as the musical piece to be played back next.

9. A music playback system according to claim 6, wherein the musical-piece-playback-information sharing section serves as a communication section for connecting a musical-piece-playback-information storage section provided in each of the plurality of music playback apparatuses to each other;

when the musical-piece-playback-information generation section included in the local apparatus generates the musical-piece playback information, the communication section sends the musical-piece playback information to other apparatuses to store the musical-piece playback information in the musical-piece-playback-information storage sections of the apparatuses in common; and the musical-piece selection section obtains the musical-piece playback information stored in the musical-piece-playback-information storage section.

10. A music playback system according to claim 9, wherein the musical-piece playback information includes the playback order of the musical piece being played back when the musical-piece playback section finishes playback, and interruption-position information indicating the position of playback interruption in the musical piece; and the musical-piece selection section selects the musical piece to be played back next by the musical-piece playback section and identifies a playback-start position according to the interruption-position information.

11. A music playback system according to claim 9, wherein the musical-piece playback information includes playback-state information for the musical-piece playback section; and the musical-piece playback section sets a playback state according to the playback-state information when the musical-piece playback section plays back a musical piece next according to the musical-piece playback information.

12. A music playback system according to claim 6, wherein the musical-piece-playback-information sharing section is a portable terminal apparatus provided with a musical-piece-playback-information storage section and provided outside the plurality of music playback apparatuses, and a communication section for connecting the portable terminal apparatus to each of the plurality of music playback apparatuses;

when the musical-piece-playback-information generation section included in the local apparatus generates the musical-piece playback information, the communication section is used to send the musical-piece playback information to the portable terminal apparatus to store the musical-piece playback information in the musical-piece-playback-information storage section; and when the musical-piece-playback-information generation section included in the local apparatus performs musical-piece playback, the musical-piece selection section obtains the musical-piece playback information stored in the musical-piece-playback-information storage section of the portable terminal apparatus, through the communication section.

13. A music playback system according to claim 12, wherein the musical-piece playback information includes the playback order of the musical piece being played back when the musical-piece playback section finishes playback, and interruption-position information indicating the position of playback interruption in the musical piece; and the musical-piece selection section selects the musical piece to be played back next by the musical-piece playback section and identifies a playback-start position according to the interruption-position information.

14. A music playback system according to claim 12, wherein the musical-piece playback information includes playback-state information for the musical-piece playback section; and the musical-piece playback section sets a playback state according to the playback-state information when the musical-piece playback section plays back a musical piece next according to the musical-piece playback information.

15. A music playback system according to claim 6, wherein the musical-piece-playback-information sharing section is a transportable storage device which stores the musical-piece playback information and an input-and-output section provided for each of the plurality of music playback apparatuses, for writing and reading the musical-piece playback information to and from the storage device;

when the musical-piece-playback-information generation section included in the local apparatus generates the musical-piece playback information, the input-and-output section writes the musical-piece playback information into the storage device; and when the musical-piece-playback-information generation section included in the local apparatus performs musical-piece playback, the musical-piece selection section reads the musical-piece playback information from the storage device through the input-and-output section and obtains it.

16. A music playback system according to claim 15, wherein the musical-piece playback information includes the playback order of the musical piece being played back when the musical-piece playback section finishes playback, and interruption-position information indicating the position of playback interruption in the musical piece; and the musical-piece selection section selects the musical piece to be played back next by the musical-piece playback section and identifies a playback-start position according to the interruption-position information.

17. A music playback system according to claim 15, wherein the musical-piece playback information includes playback-state information for the musical-piece playback section; and the musical-piece playback section sets a playback state according to the playback-state information when the musical-piece playback section plays back a musical piece next according to the musical-piece playback information.

* * * * *